US005437078A

United States Patent [19]

Courcelles

[11] Patent Number: 5,437,078

[45] Date of Patent: Aug. 1, 1995

[54] DUST PAN FOR USE WITH A VACUUM

[76] Inventor: J. A. Denis Courcelles, 1356 des Mouettes Street, Longueil, Québec, Canada, J4J 5K2

[21] Appl. No.: 180,315

[22] Filed: Jan. 12, 1994

[30] Foreign Application Priority Data

Jan. 18, 1993 [CA] Canada ..... 2087474

[51] Int. Cl.[6] ..... A47L 5/36

[52] U.S. Cl. ..... 15/328; 15/257.2; 15/415.1

[58] Field of Search ..... 15/301, 310, 415.1, 15/257.2, 328

[56] References Cited

U.S. PATENT DOCUMENTS

| | | | |
|---|---|---|---|
| 1,480,562 | 1/1924 | Mock | 15/344 X |
| 1,898,887 | 2/1933 | Naul | 15/310 X |
| 3,018,502 | 1/1962 | Lossius | 15/257.2 |
| 3,027,588 | 4/1962 | Bierstock | 15/301 |
| 3,056,993 | 10/1962 | Lewis | 15/310 |
| 3,220,042 | 11/1965 | Harrington | 15/415.1 X |
| 3,408,681 | 11/1968 | Isakson | 15/257.2 |
| 4,360,947 | 11/1982 | DeCosa et al. | 15/415.1 X |
| 5,279,016 | 1/1994 | Klassen | 15/301 |

FOREIGN PATENT DOCUMENTS

| | | | |
|---|---|---|---|
| 675552 | 12/1963 | Canada | 15/315 |

*Primary Examiner*—Christopher K. Moore
*Attorney, Agent, or Firm*—Swabey Ogilvy Renault

[57] ABSTRACT

The present invention relates to a dust pan adapted to be used with a vacuum and which allows for collected dust to be drawn up by the vacuum. The dust pan of the present invention comprises a bottom wall and side walls defining a pan unit. The bottom wall downwardly extends to substantially evenly rest on a floor surface. The dust pan further comprises tubular means adapted to be engaged with a vacuum source. The tubular means are connected at the rear of the pan unit and are in communication with the interior of the pan. The dust pan can optionally include a spring clip for releasable attachment to a broom stem portion.

6 Claims, 1 Drawing Sheet

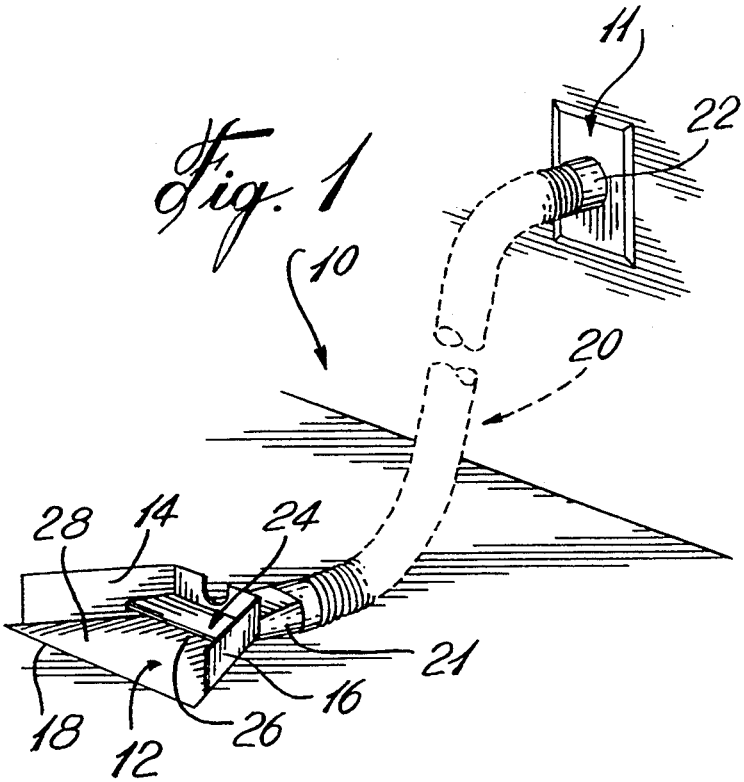
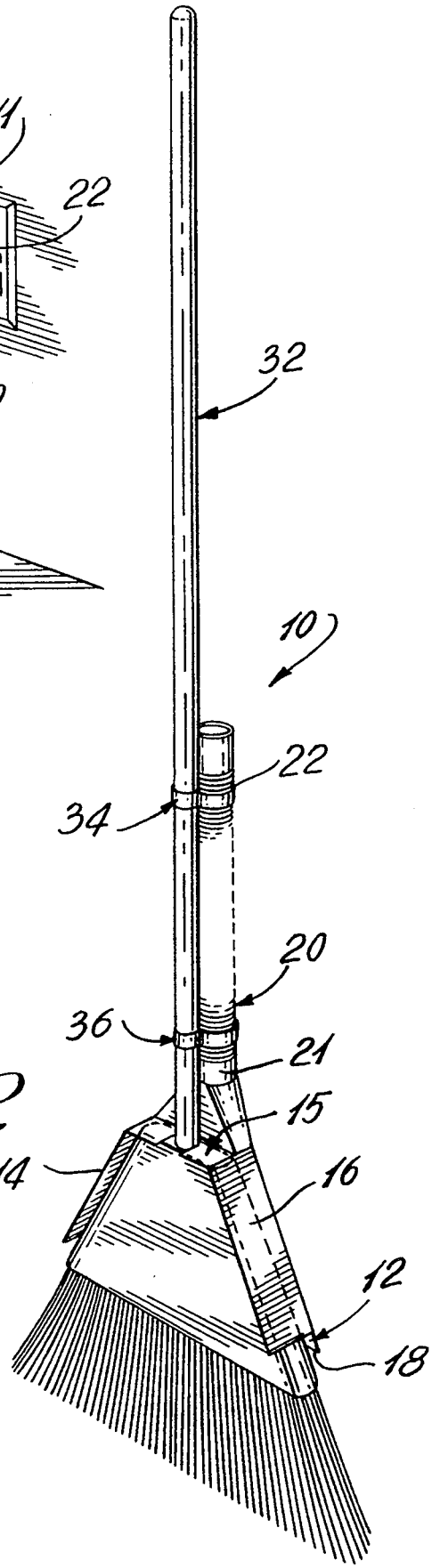
Fig. 2

DUST PAN FOR USE WITH A VACUUM

BACKGROUND OF THE INVENTION

1. Field of the Invention

The invention relates to a dust pan for use with a vacuum which draws the dust that is collected in the dust pan.

2. Description of Prior Art

Although dust pans known to date have a variety of shapes, they all are designed as a shovel-shaped pan to receive and contain sweepings and dust that have been collected with a broom on a floor surface. The disposal of the collected dust in any one of these dust pans is effected manually in a garbage can or the like. person using one of the usual dust pans may unintentionally drop some of the collected dust on the floor surface while manually disposing of the collected dust, which is of course a serious inconvenient.

There is disclosed, in Canadian Patent 741,940 issued on Sep. 6, 1966, in the name of Francis C. Harrington et al., a cleaning nozzle for cleaning hot water radiators of the baseboard radiant heat type. Over a period of time, dust and lint enter the radiator housing through the convection openings and settle on the fins and water pipe. An object of this cleaning nozzle is to provide a radiator cleaning apparatus that is adapted for use in conjunction with conventional vacuum cleaners and which may be utilized in conjunction with the attachments provided with such cleaners. In operation, this cleaning nozzle must rest horizontally on the floor surface with a portion being inserted under the radiator. This cleaning nozzle cannot be used in conjunction with a vacuum and does not provide for a dust pan to be used with a broom on a floor surface.

It would be highly desirable that a dust pan be adapted to be used in conjunction with a vacuum and which would allow for the collected dust to be drawn up by the vacuum without dropping any of the collected dust on a floor.

SUMMARY OF THE INVENTION

One aim of the present invention is to provide a dust pan adapted to be used in conjunction with a vacuum where the collected dust is drawn up by the vacuum without dropping any of the collected dust on a floor surface.

Another aim of the present invention is to provide a dust pan having a spring clip for the releasable attachment to a broom handle.

In accordance with one embodiment of the present invention there is provided a dust pan adapted to be used with a vacuum comprising, a pan unit having a bottom wall including a front end and a rear end, side walls oppositely disposed between the front end and the rear end, the front end being formed with means resting on a floor surface, tubular means and means for connecting the tubular means at the rear end of the bottom wall in communication with the interior of said pan, wherein said tubular means is adapted to be engaged with a vacuum source, thereby allowing for collected dust in said dust pan to be drawn up by a vacuum.

In accordance with another embodiment of the present invention there is provided a dust pan having a bottom wall which is outwardly flaring toward the front end, the front end is downwardly extending to substantially evenly rest on a floor surface and said tubular means is connected at the rear end between said side walls through said connecting means.

In accordance with another embodiment of the present invention there is provided a dust pan adapted to be used with a vacuum comprising, a pan unit having substantially spaced apart top and bottom walls, and connecting side walls therebetween defining an inner space, said inner space having a front open side and a rear end, said rear end terminated by a rear wall, said rear wall having an opening, the bottom wall extending beyond the top wall at said open side and downwardly extending to substantially evenly rest on a floor surface; and tubular means connected to said inner space through said opening and being in communication therewith and means enabling said tubular means to be engaged with a vacuum source, thereby allowing for collected dust in said dust pan to be drawn up by a vacuum.

BRIEF DESCRIPTION OF THE DRAWINGS

Having thus generally described the nature of the invention, reference will now be made to the accompanying drawings, showing by way of illustration a preferred embodiment thereof, and wherein:

FIG. 1 is a perspective view of the dust pan in a connecting position with a vacuum source; and FIG. 2 is a perspective view of an embodiment of the dust pan of the present invention attached to a broom.

DETAILED DESCRIPTION OF THE INVENTION

With reference to the drawings, it will be seen that the dust pan 10 according to one embodiment of the invention is shown in FIG. 1 in a connecting position with a vacuum source. The dust pan 10 has a bottom wall 12, side walls 14 and 16 and a rear wall 15 (FIG. 2). A front end 18 of the bottom wall 12 downwardly extends to substantially evenly rest on a floor surface so as to facilitate the entry of the sweepings in the dust pan 10 using a broom. A flexible hose 20 has one end 21 attached to the rear wall 15 of the dust pan 10 at the rear end. The flexible hose 20 has a sleeve 22 at its free end adapted to engage with a vacuum source 11.

In accordance with one embodiment of the present invention, the dust pan 10 is outwardly flaring toward the front end and the rear wall 15 is used to connect the flexible hose 20.

In accordance with another embodiment of the present invention, the dust pan 10 further includes a top wall 24 which is substantially parallel to the bottom wall 12. The bottom wall 12 and the top wall 24 are spaced apart from each other and are connected together by means of side walls 14 and 16 and rear wall 15 to define an inner space 26. An opening (not shown) in the rear wall 15 provides a rear access to the inner space. The edge 18 of the bottom wall 12 is defined by an extension 28 of the bottom wall 12 beyond the top wall 24 to substantially evenly rest on a floor surface. The inner space 26 is in communication with the end 21 of the flexible hose 20 through the opening provided in the rear wall 15.

The dust pan 10 as shown in FIG. 2 can be releasably attached to a broom stem 32 by means of spring clips 34, 36. Thus, the dust pan 10 in accordance with the present invention can be attached to a broom for storage.

The dust pan 10 in accordance with the present invention can be made of plastic materials, such as polyethylene amongst others, by injection molding or other techniques.

The dust pan 10 can be of a variety of shapes, such as trapezoidal, rectangular and the like.

The vacuum source 11 in accordance with the present invention may be provided by a central vacuum system.

The floor surface in accordance with the present invention is preferably substantially planar and smooth.

While the invention has been described with particular reference to the illustrated embodiment, it will be understood that numerous modifications thereto will appear to those skilled in the art. Accordingly, the above description and accompanying drawings should be taken as illustrative of the invention and not in a limiting sense.

I claim:

1. A dust pan for use with a vacuum comprising, a pan unit adapted to collect dust having a bottom wall including a front end and a rear end, side walls oppositely disposed between said front end and said rear end, said front end downwardly extending to substantially evenly rest on a floor surface, a top wall spaced from said bottom wall and disposed between said side walls at the rear end of said bottom wall to define an inner space, and a rear wall disposed between the rear end of said bottom wall and said top wall having an opening therein, conduit means comprising a nozzle adapted to receive the collected dust and a hollow sleeve adapted to be engaged with a vacuum source allowing for collected dust in said dust pan to be drawn up by said vacuum, and means for connecting said nozzle to the rear end of said bottom wall, and attachment means mounted on said conduit means for releasably attaching said dust pan to a broom.

2. A dust pan according to claim 1, wherein said conduit means comprises a flexible hose connected to said pan unit.

3. A dust pan according to claim 2, wherein said bottom wall is outwardly flaring toward said front end, and said conduit means is connected to said rear end between said side walls through said connecting means.

4. A dust pan according to claim 1, wherein said opening in said top wall enabling said conduit means to be in communication with said Inner space.

5. A dust pan according to claim 1, wherein said top wall partially covers said bottom wall.

6. A dust pan according to claim 1, wherein said attachment means comprises at least one spring clip having one end attached to said conduit means and one free end for releasably engaging the handle of said broom.

* * * * *